US005169449A

United States Patent [19]

Raught

[11] Patent Number: 5,169,449

[45] Date of Patent: Dec. 8, 1992

[54] APPARATUS FOR APPLYING JOINT COMPOUND TO CORNER BEADS

[76] Inventor: Jerry E. Raught, 223 165th Ave., N.E., Bellevue, Wash. 98008

[21] Appl. No.: 560,367

[22] Filed: Jul. 31, 1990

[51] Int. Cl.[5] ..... B05C 3/02; B05C 3/10

[52] U.S. Cl. ..... 118/404; 118/415; 118/429; 118/DIG. 2; 425/113

[58] Field of Search ..... 118/404, 415, 429, DIG. 2, 118/405, 427; 425/113, 87, 458

[56] References Cited

U.S. PATENT DOCUMENTS

| | | | |
|---|---|---|---|
| 163,825 | 5/1875 | Wallick | 118/408 |
| 2,331,983 | 10/1943 | Kaiser, Jr. | 118/404 |
| 3,084,662 | 4/1963 | Badger | 118/404 |
| 4,259,379 | 3/1981 | Britton et al. | 118/404 |
| 4,778,367 | 10/1988 | Hilakos | 425/113 |

FOREIGN PATENT DOCUMENTS

| | | | |
|---|---|---|---|
| 2525246 | 12/1975 | Fed. Rep. of Germany | 118/405 |
| 2908522 | 9/1980 | Fed. Rep. of Germany | 118/405 |
| 3002732 | 8/1981 | Fed. Rep. of Germany | 118/404 |

*Primary Examiner*—Jay H. Woo
*Assistant Examiner*—Khanh P. Nguyen
*Attorney, Agent, or Firm*—Schiller & Kusmer

[57] ABSTRACT

A device for applying a thin layer of joint compound to the inner and outer surfaces of a corner bead. The device includes a hopper for supporting a quantity of joint compound. The hopper has two openings which are aligned with one another and have a cross-sectional configuration corresponding to that of a corner bead. The device includes rubber panels for closing off a selected portion of the openings. In use, a corner bead is inserted through one of the openings, pushed through the hopper where joint compound adheres to the bead, and is extracted from the other opening. The rubber panels scrape off all but a thin layer of joint compound from the concave surface of the bead and forces the bead against the bottom of the hopper so as to permit only a thin layer of joint compound to remain on the convex surface of the bead.

6 Claims, 2 Drawing Sheets

APPARATUS FOR APPLYING JOINT COMPOUND TO CORNER BEADS

FIELD OF THE INVENTION

The present invention relates to devices used in connection with the installation of gypsum or other wall board, and more particularly to devices for applying joint compound to corner beads prior to attachment of the latter to the gypsum or other wall board.

BACKGROUND OF THE INVENTION

Due to the relatively brittle and crushable nature of gypsum board and joint compound applied to conceal the joints between adjacent gypsum board panels, a metal corner bead is typically applied to cover corners where adjacent gypsum board panels meet. The metal corner bead typically consists of a long, narrow strip of sheet metal folded widthwise along its center line so as to provide a V-shaped cross-section across its width with the portions of the strip opposite the center line being adapted to be secured to the two adjacent boards where they join at a corner. When viewed in cross section, the strip portions typically extend perpendicular from the center line to one another. However, the angle formed in the strip may be at other angles when the panels forming the corner to be covered with a bead are not perpendicular to one another. In some instances the two strip portions of a corner bead meet at a rounded "nose" so that rounded corners between panels can be provided. Traditionally, these rounded corners have been formed with a relatively small (about 0.01") radius, although recently corner beads with relatively larger radii (about 0.5–1.5") have been formed. The large-radius beads are typically referred to as bullnose corner beads. Often, corner beads include perforated paper attached to the inner and outer surfaces thereof.

One method of finishing the corners of adjacent panels involves installing a corner bead so as to cover the portions of the panels meeting at a corner. This installation is accomplished by inserting sheet rock screws or other fasteners through apertures in the beads and into the panels. Then, multiple coatings of joint compound are applied to the beads and sanded until a smooth corner is achieved.

Another technique for attaching corner beads involves applying joint compound to the inner and outer surfaces of a bead, and then pressing the bead against the corner. As the joint compound on the surfaces of the bead dries, an adhesive bond is achieved between the wall and the corner bead. As such, the need to attach the bead to the corner with fasteners is avoided. After the joint compound on the bead has dried and has been sanded, additional layers of joint compound are typically applied and finished.

Although the above-described processes for finishing a corner where adjacent panels meet produce a satisfactory corner, these processes tend to be relatively labor intensive, and hence costly. In particular, it takes a significant amount of time to apply and sand the joint compound so as to achieve a smooth corner. Additionally, when a corner bead is applied without the use of fasteners, it tends to be difficult to apply an even thickness of joint compound to both surfaces of the corner bead.

OBJECTS AND SUMMARY OF THE INVENTION

One object of the present invention is to provide a device for use in installing corner beads at corners where adjacent panels meet more quickly and easily than is typically possible with conventional devices and techniques.

Another object of the present invention is to provide a device for applying a thin, uniform layer of joint compound to the inner and outer surfaces of a corner bead in a quick and easy manner.

These and other objects are achieved by a device for applying a thin layer of joint compound to the inner and outer surfaces of a corner bead of the type used to protect corners where adjacent dry wall panels meet. The device comprises a generally V-shaped hopper or trough which is closed at its ends. A pair of openings are provided in a bottom portion of the end walls of the hopper. The openings are aligned and in communication with the bottom of the hopper, and have a cross sectional configuration selected to permit corner beads having a range of different shapes and sizes to be inserted through the openings.

The device additionally includes one or more pairs of triangularly-shaped insert panels. The bottom corners of both of the insert panels of a given pair have a configuration corresponding to the cross-sectional configuration of the corner bead to be coated with joint compound. The insert panels are slidably mounted to the inner surfaces of the end walls of the hopper so that the bottom corners of the panels point down to the base of the hopper. By moving the insert panels up and down along the inner surfaces of the end walls, the openings in the end walls may be progressively opened or closed off. Due to the configuration of the bottom corners of the insert panels, the openings retain the cross-sectional configuration of the associated corner bead even as the openings are progressively closed off.

To use the device, the latter is at least partially filled with joint compound and the insert panels are adjusted to close off a selected portion of the openings in the end walls. This selected portion is determined based on the desired thickness of joint compound to be applied to the corner bead. Next, a corner bead is inserted, concave side up, into the opening in one of the end walls at one end of the hopper, is passed through the hopper, and is removed through the opening in the other end wall at the opposite end of the hopper. As the corner bead passes through the hopper, joint compound is applied to both the convex and concave surfaces of the bead. As the bead passes out of the hopper through the second opening, the associated insert panel scrapes off joint compound from the concave surface of the bead so that a uniformly-thick layer of joint compound remains on the concave surface of the bead. Additionally, the rubber insert panels force the bead downwardly against the bottom of the hopper thereby permitting only a thin layer of joint compound to be applied to the convex surface of the bead.

The present device also includes an insert assembly for adapting the hopper so that the latter may be used to apply joint compound to the surfaces of several different types of corner beads.

BRIEF DESCRIPTION OF THE DRAWINGS

For a fuller understanding of the nature and objects of the present invention, reference should be made to the following detailed description taken in connection with the accompanying drawings wherein.

DETAILED DESCRIPTION OF THE INVENTION

Figure 1:
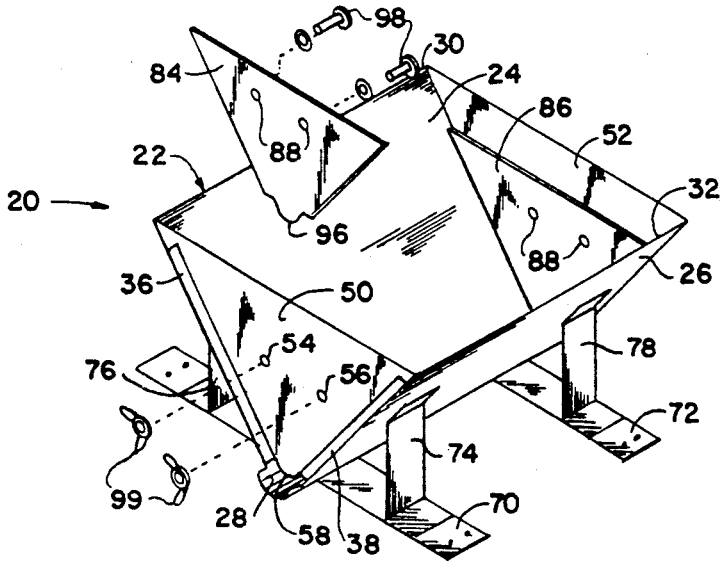
FIG. 1 is a perspective view of the hopper of the present invention, including the rubber insert panels used when joint compound is to be applied to a bullnose corner bead.

Referring to FIG. 1, the present invention is a hopper 20 for applying joint compound to both sides of a corner bead. More particularly, the present invention is designed for use in applying joint compound to both sides of a corner bead of the type to be pressed in place, rather than nailed, at the corner of adjacent dry wall panels. Such pressed-on corner beads typically have paper tape attached to both the concave and convex surfaces thereof. However, under certain circumstances hopper 20 may also be useful in applying joint compound to corner beads which are to be nailed in place.

As described in greater detail below, hopper 20 is designed to apply joint compound to the surfaces of corner beads having a variety of different cross-sectional configurations. One such corner bead is identified as a B1W tape-on metal corner bead. This bead has a V-shaped cross sectional configuration, with the sides of the V being of equal length and positioned to extend perpendicular to one another. Another such corner bead is identified as a "L-metal" bead, the latter having an L-shaped cross sectional configuration in which the sides are of different dimensions. Additionally, hopper 20 may be used to apply joint compound to bullnose corner beads, such as the type manufactured by Beadx Manufacturing Company of Renton, Wa. As viewed in cross section, the radius of curvature of the curved portion of a bullnose corner bead typically ranges from 0.5" to 1.5".

Hopper 20 comprises a V-shaped trough 22 having side walls 24 and 26. Trough 22 is typically formed from a single piece of sheet metal which is folded along a mid-length portion thereof so as to form side walls 24 and 26. This folding is accomplished so that side walls 24 and 26 extend substantially perpendicular to one another. Trough 22 additionally includes a U-shaped channel 28 at the base of the trough positioned at the line of intersection of side walls 24 and 26. The concave surface of channel 28 faces upwardly into trough 22. In a preferred embodiment of the present invention, trough 22 has a length of about 15 inches, as measured along top edges 30 and 32 of side walls 24 and 26, respectively. Also, in the preferred embodiment, each of the side walls 24 and 26 has a height of about 12", as measured between the top edges 30 and 32 of the side walls and the base of channel 28. Additionally, in the preferred embodiment, channel 28 has a cross-sectional radius of curvature of about 0.625".

Figure 3:
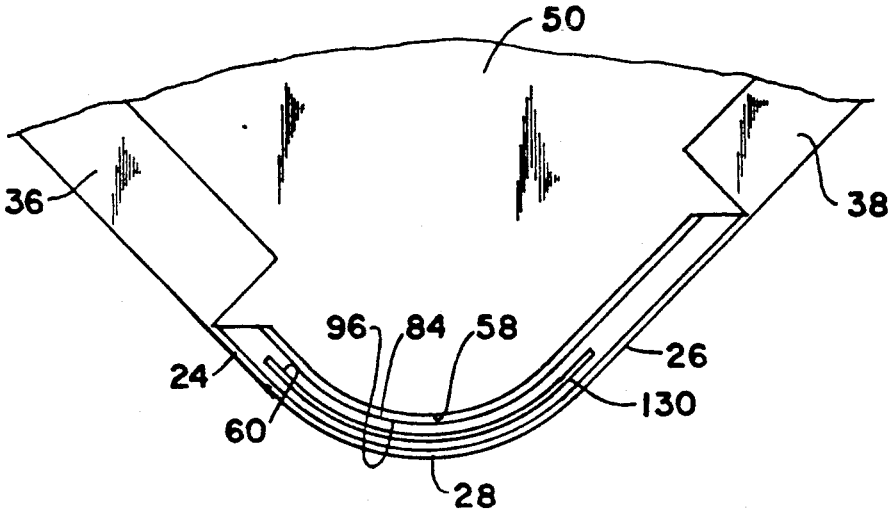
FIG. 3 is an enlarged, fragmentary, front elevation view of the bottom portion of one of the end walls of the hopper showing the manner in which the insert panel removes all but a uniformly thick layer of joint compound from the surfaces of a bullnose corner bead being removed from the opening in the end wall of the hopper.

Referring now to FIGS. 1 and 3, trough 22 includes elongate tabs 36 and 38 extending along the front edges of side walls 24 and 26, respectively. Tabs 36 and 38 have a width of about 0.5", and extend perpendicular to side walls 24 and 26. As best seen in FIG. 3, the lower ends of tabs 36 and 38 terminate above the base of channel 28. Preferably, tab 36 terminates about 2" above the base of channel 28 and tab 38 terminates about 2.5" above the base of channel 28. Because tabs 36 and 38 are typically formed by folding back portions of the front edges of side walls 24 and 26, respectively, channel 28 projects a distance equal to the width of tabs 36 and 38 beyond the front edge of trough 22.

Trough 22 additionally includes elongate tabs (not shown) attached to the rear edges of side walls 24 and 26 which are identical in shape and configuration to tabs 36 and 38. Channel 28 also preferably extends beyond the rear edge of trough 22 a distance equal to the width of the tabs attached to the rear edges of the sidewalls.

Trough 22 also includes generally triangularly-shaped end walls 50 and 52. End wall 50 is attached to trough 22 via tabs 36 and 38 by spot welding or other known techniques. End wall 50 includes elongate slots 54 and 56 which are positioned adjacent one another. End wall 50 additionally includes rounded bottom corner 58. The radius of curvature of bottom corner 58 corresponds to, or is slightly less than, the radius of curvature of channel 28, i.e. 0.5"-0.625". End wall 50 is sized and attached to trough 22 so that an opening 60 (FIG. 3) is formed between channel 28 and rounded corner 58. Opening 60 has a width, as measured between bottom corner 58 and the inside surface of channel 28, of about 0.50". Opening 60 extends along the entire width of channel 28, up side wall 24 to the bottom portion of tab 36, and up side wall 26 to the bottom portion of tab 38. Because the bottom portion of tab 38 is spaced a greater distance from the base of channel 28 than the bottom portion of tab 36, opening 60 extends a greater distance up side wall 26 than up side wall 24.

Figure 2:
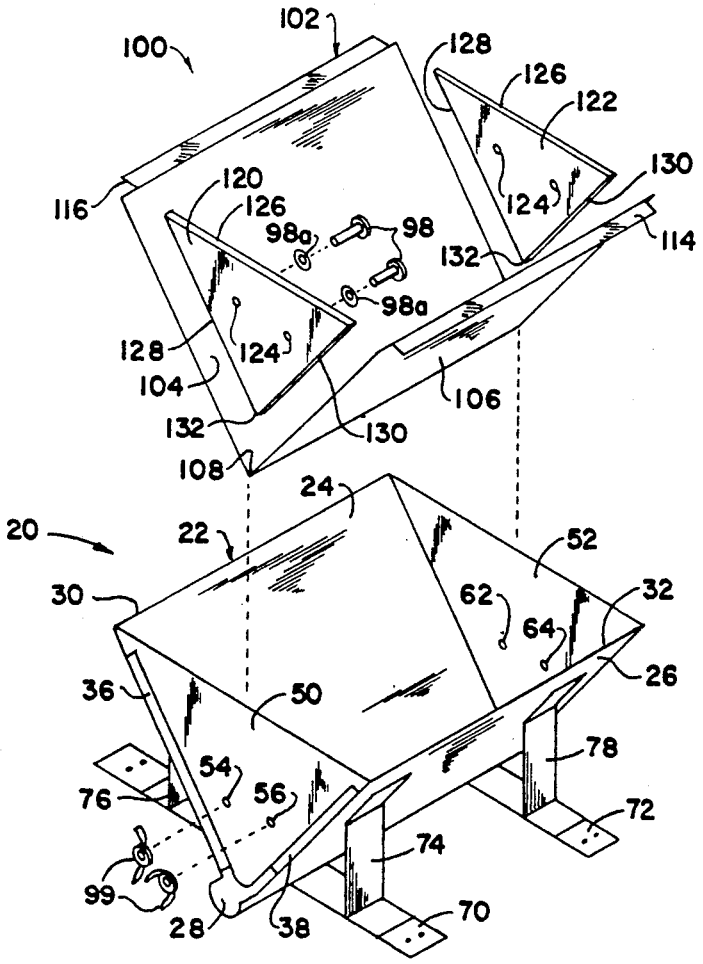
FIG. 2 is similar to FIG. 1, except that the insert panels used with bullnose corner beads have been removed and an insert assembly for adapting the hopper for use with conventional corner beads is shown above the hopper.

Referring to FIGS. 1-3, end wall 52 has an identical size and configuration to that of end wall 50. Additionally, end wall 52 is attached via the tabs (not shown) attached the rear edges of side walls 24 and 26 so that an opening (not shown) corresponding in size and configuration to that of opening 60 is formed between the bottom corner of end wall 52 and the inside surface of the rear portion of channel 28. Thus, the opening formed between the bottom corner of end wall 52 and channel 28 extends along the entire width of channel 28, and up side wall 26 a greater distance than it extends up side wall 24. As seen in FIG. 2, end wall 52 includes elongate slots 62 and 64. The latter correspond in size and mutual spacing to that of slots 54 and 56.

Hopper 20 additionally includes a base assembly for supporting trough 22. The base assembly includes flat, elongate plates 70 and 72, and upstanding legs 74, 76, 78 and a fourth leg (not shown) opposite leg 78. The legs are all identical in configuration, and legs 74 and 76 are attached between plate 70 and side walls 26 and 24 respectively, so as to support the front portion of trough 22 above plate 70. Similarly, leg 78 and the corresponding opposite leg (not shown) are attached to plate 72 so as to support the rear portion of trough 22 above plate 72.

Hopper 20 additionally includes insert panels 84 and 86. Panels 84 and 86 are identical in size and configuration, and each include a pair of holes 88 extending therethrough. Holes 88 are spaced from one another a distance corresponding to the distance between elongate slots 54 and 56 in end wall 50 and elongate slots 62 and 64 in end wall 52.

Figure 4:
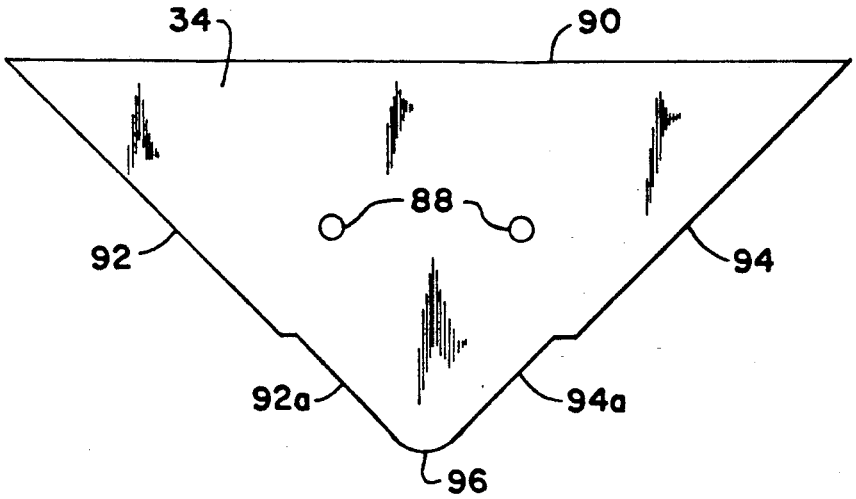
FIG. 4 is a side elevation view of one of the rubber insert panels used with the hopper when applying joint compound to a bullnose corner bead.

As seen in FIG. 4, panel 84 (and also panel 86, since it is identical in size and configuration to panel 84) comprises a top edge 90, a side edge 92, and an opposite side edge 94. Side edges 92 and 94 extend perpendicular to one another and at 45° angles to top edge 90. Panel 84 includes a rounded corner 96 at the junction of side walls 92 and 94, corner 96 has a radius of curvature corresponding to that of channel 28, i.e. a radius of curvature of about 0.5". The portions of side walls 92 and 94 adjacent corner 96 are recessed slightly, e.g. about 0.15". These recessed portions, identified at **92*a* and, 94*a* in FIG. 4, preferably extend about 2" up the side edges from the center of rounded corner 96. In a preferred embodiment of the invention, top edge 90 has a length of about 9.75" and side walls 92 and 94 have a length of about 6.89", as measured between the intersection of the side walls with top edge 90 and the center of rounded corner 96. The configuration and sizing of panel 86 is identical to that of panel 84**.

Panels 84 and 86 are preferably made from hard rubber. However, other materials such as wood, plastic or metal may also be used.

Hopper 20 also includes screws 98, and wing nuts 99 for use in securing insert panels 84 and 86 to end walls 50 and 52, respectively. Screws 98 are sized to be received in holes 88 in plates 84 and 86 and in slots 54 and 56 in end wall 50 and in slots 62 and 64 in end wall 52. The thread pitch and diameter of the bore in wing nuts 99 are selected so the latter may be threadedly engaged with screws 98.

As discussed in greater detail below, insert panels 84 and 86 adapt hopper 20 for use in applying joint compound to the surfaces of a bullnose corner bead. Hopper 20 also includes an insert assembly 100 (FIG. 2) for adapting the hopper for use in applying joint compound to the surfaces of a B1W bead or an L-metal bead. As discussed below, insert panels 84 and 86 are removed prior to the installation of insert assembly 100.

Insert assembly 100 comprises an elongate liner 102 having a V-shaped cross-sectional configuration. Liner 102 is typically formed from a single piece of sheet metal which is folded along a mid-length portion thereof so as to provide side walls 104 and 106 which extend perpendicular to one another and a channel 108 extending along the line of intersection of the sidewalls. Channel 108 has a substantially right angle configuration. Liner 102 additionally includes an elongate flange 114 attached to the upper edge of side wall 106 and an elongate flange 116 attached to the upper edge of side wall 104. Flanges 114 and 116 preferably extend along the majority of the length of the upper edges of sidewalls 106 and 104, respectively. Additionally, flanges 114 and 116 extend roughly perpendicular to sidewalls 106 and 104, respectively, and project outwardly from walls 106 and 104, respectively, about 1".

In a preferred embodiment of insert assembly 100, liner 102 has a length just slightly less than the spacing between end wall 50 and end wall 52 so that when the member liner 102 is inserted in trough 22, liner 102 extends along substantially the entire length of the interior of trough 22. The length and height of side walls 104 and 106 are selected so that when the liner 102 is positioned in trough 22 so that the channel 108 of liner 22 rests in channel 28 of trough 22, upper edge 30 of side wall 24 will contact the bottom surface of flange 116 and upper edge 32 of side wall 26 will contact the bottom surface of flange 114.

Insert assembly 100 additionally includes insert panels 120 and 122. Panels 120 and 122 are identical to one another and are preferably made of rubber. Each comprise two apertures 124 extending therethrough. The spacing between the apertures 124 of panels 120 and 122 is identical to the spacing between elongate slots 54 and 56 in end wall 50 and elongate slots 62 and 64 in end wall 52. Slots 124 are also sized to received screws 98.

Panels 120 and 122 are similar in configuration to panels 84 and 86, with the exception of the bottom corners of the panels 120 and 122. More specifically, panels 120 and 122 include a top edge 126 (FIG. 2), a side edge 128 and an opposite side edge 130. Side edges 128 and 130 extend perpendicular to one another and at a 45° angle to the top edge 126. Side edges 128 and 130 meet at bottom corner 132, which has a substantially right angle configuration, unlike the curved configuration of bottom corner 96 of end panels 84 and 86. In a preferred embodiment of the present invention, the top edges 126 of rubber panels 120 and 122 have a length of about 8" and the side edges 128 and 130 have a length of about 5.66".

In connection with the following description of the operation of hopper 20, reference should be made to FIGS. 1–4. Initially, the process for applying joint compound to a bullnose corner bead will be described. Then, the process for applying joint compound to a B1W corner bead or a L-metal bead will be described.

As the first step in the procedure for applying joint compound to a bullnose corner bead, sufficient joint compound is added to hopper 20. Next, rubber panel 84 is positioned against the inside surface of end wall 50 so that the rounded corner 96 points downwardly and so that one of the apertures 88 is aligned with slot 54 and the other of the apertures 88 is aligned with slot 56. Then, screws 98 are inserted through apertures 88 and slots 54 and 56 and wing nuts 99 are threaded on screws 98 and loosely tightened so that screws 98 and hence panel 84 attached thereto may slide up and down in elongate slots 54 and 56. Rubber panel 86 is attached to end wall 52 in a similar manner.

Panel 84 is then moved up or down, as required, along end wall 50 so as to close off a selected portion of opening 60 formed between channel 28 and bottom corner 58 of end wall 50, as shown in FIG. 3. The extent to which opening 60 is closed off by panel 84 depends on the desired thickness of joint compound to be applied to the concave and convex surfaces of the bullnose corner bead. Typically, rubber panel 84 is adjusted so that the width of opening 60 is about ⅜". After rubber panel 84 has been properly adjusted, wing nuts 99 are tightened so as to hold the panel in place. Then, rubber panel 86 is similarly positioned relative to end wall 52, and then is secured by appropriate tightening of the wing nuts (not shown) attached to the screws 98 extending through panel 86.

Then, a bullnose corner bead 130 (FIG. 3) is inserted into the opening (not shown) provided between the bottom corner of panel 86 and channel 28, is pushed through the interior of hopper 22, and is pushed out through that portion of opening 60 which is not closed off by the bottom corner 96 of panel 84. As bullnose bead 130 passes through the interior of hopper 22, the joint compound in trough 22 adheres to the concave and convex surfaces of the bead. As bullnose bead 130 is extracted from opening 60, the rounded corner 96 of panel 84 scrapes all but a thin layer of joint compound from the concave surface of the bullnose bead. Similarly, because panel 84 forces bullnose bead 130 downwardly towards channel 28, most of the joint compound positioned between the convex surface of the bead and channel 28 is forced out from between the bead and the channel. As such, only a relatively thin layer of joint compound remains adhered to the convex surface of bullnose bead 130 as it is extracted from opening 60. Because in most cases, bullnose corner beads of the type having paper tape attached to the concave and convex surfaces thereof are used, the foregoing procedures result in joint compound being applied directly to the paper tape covering the concave and convex surfaces.

Because the radius of curvature of channel 28 is similar, if not identical, to that of bullnose bead 130, the layer of joint compound applied to the convex surface of bullnose bead 130 is substantially uniform across the width of the bead. Similarly, because the configuration of rounded corner 96 is similar, if not identical, to that of the concave surface of bullnose bead 130, the layer of joint compound applied to the concave surface of bead 130 is substantially uniform across the width of the bead.

In certain applications, for instance where a corner bead is to be attached to a relatively tall, e.g. 20', corner, the rubber plates 84 and 86 are adjusted so that a relatively thick layer, e.g. ⅛", of joint compound is applied to the concave and convex surfaces of bullnose bead 130. Alternatively, when bullnose bead 130 is to be applied to a smooth and relatively short, e.g. 8', corner, end plates 84 and 86 are adjusted so as to close off a greater portion of opening 60 and the corresponding opening below end wall 52, whereby a relatively thin, e.g. 1/16", layer of joint compound is applied to the concave and convex surfaces of bullnose bead 130.

When it is desired to apply joint compound to a B1W bead or to a L-metal corner bead, rubber plates 84 and 86 are detached from end walls 50 and 52, respectively. Next, liner 102 is inserted in trough 22 so that channel 108 of liner 102 rests in channel 28 of trough 22. In this configuration flanges 114 and 116 will engage and rest on upper edges 32 and 30 of side walls 26 and 24, respectively. As a consequence of this engagement, insert 102 is automatically aligned in fixed relation to trough 22. Then, rubber panels 120 and 122 are loosely attached to the inside surfaces of end walls 50 and 52 using screws 98 and wing nuts 99 in accordance with the process described above for attaching panels 84 and 86 to the end walls. Then, panels 120 and 122 are moved up or down, as required, so as to close off a selected portion of opening 60 and the corresponding opening below end wall 52, depending upon the thickness of joint compound to be applied to the B1W metal bead or the L-metal corner bead. After filling liner 102 with joint compound, a B1W or L-metal bead is inserted into the opening (not shown) below end wall 52. The bead is then pushed through the interior of liner 102 and out through opening 60 below end wall 50.

As the B1W or L-metal bead is extracted from opening 60, the bottom corner 132 of rubber plate 120 scrapes all but a thin layer of joint compound from the concave surface of the bead. Additionally, because rubber plate 120 forces the B1W metal or L-metal corner bead against the inside surface of channel 108 of liner 102, all but a thin layer of joint compound is forced out from between the convex surface of the corner bead and channel 108. As a result, a thin, uniform layer of joint compound is also applied to the convex surface of the B1W or L-metal corner bead as it is extracted from opening 60. Because corner 132 of end plate 120 and channel 108 each have a substantially right angle configuration which corresponds to the cross sectional configuration of the B1W metal or L-metal corner bead, the thin layer of joint compound applied to the concave and convex surfaces of the B1W tape on metal or L-metal tape on corner bead is of uniform thickness as measured across the width of the corner bead.

Because one side of the L-metal corner bead is longer than the other, it is necessary that the L-metal bead be inserted into the opening below end wall 52 so that the wider side of the L-metal corner bead is on the wider side of opening 60. That is, the L-metal corner bead is inserted so that the wider side of the bead is positioned adjacent side wall 26.

Under certain circumstances it may be desirable to provide several pairs of insert panels 84 and 86, each pair having a unique radius of curvature on its bottom corner 96 corresponding to the radius of curvature of a given bullnose bead to be applied using the present invention. For example, if bullnose beads having radii of curvature of 0.75" and 1.5" are to be coated with joint compound using hopper 20, then a first pair of panels 84 and 86 having a rounded corner 96 with a radius of about 0.75" is provided for use with the 0.75" radius beads and a second pair of panels 84 and 86 having a rounded corner 96 with a radius of about 1.5" is provided for use with the 1.5" radius beads.

Additionally, several different pairs of panels 120 and 122 may be provided, each having a unique configuration at the corner 132 thereof corresponding to the cross-sectional configuration of corner beads to be used with the present invention.

An important advantage of the present invention is that it permits a thin layer of joint compound to be applied to a corner bead in a quick and efficient manner.

Another important advantage of the present invention is that it is designed to apply joint compound to corner beads of differing cross section configurations.

Yet another advantage of the present invention is that the thickness of joint compound applied to the corner bead may be quickly and easily varied by adjustment of rubber plates 84 and 86, or 120 and 122, as the case may be.

Since certain changes may be made in the above apparatus without departing from the scope of the invention herein involved, it is intended that all matter contained in the above description or shown in the accompanying drawings shall be interpreted in an illustrative and not in a limiting sense.

What is claimed is:

1. A device for applying joint compound to the concave and convex surfaces of a corner bead, the device comprising: a hopper having an interior for storing a quantity of joint compound, said hopper having a first concave, elongate channel having a first cross sectional configuration, said first channel being coupled with said interior of said hopper, and first and second openings each being aligned and in communication with said first channel in order for a corner bead to be inserted through said first opening, moved along said first channel, and withdrawn from said second opening, at least said second opening having a cross sectional configuration corresponding to that of said corner bead; and an insert member having a second concave, elongate channel, the second channel having a second cross sectional configuration, said insert member being sized and configured for receipt in said first channel in order for said second channel to be positioned in said first channel so as to extend along said first channel.

2. A device according to claim 1 wherein said insert member includes registration means for coacting with said hopper so as to automatically position said first channel in predetermined aligned relation with said second channel.

3. A device according to claim 1 wherein said insert member comprises an elongate trough having a V-shaped cross sectional configuration, said second channel being positioned at a base portion of said trough, said trough being sized and configured so as to coact with said hopper when inserted in said hollow interior of said hopper so that said second channel is aligned with and in communication with said first and second openings.

4. A device according to claim 1 further comprising support means coupled with said hopper for supporting said hopper in predetermined relation to a surface on which said device is positioned.

5. An apparatus for applying joint compound to concave and convex surfaces of a corner bead, the apparatus comprising:

first and second sidewalls attached together so as to extend transversely to one another;

front and rear end walls attached to said first and second sidewalls so as to form together with said sidewalls a chamber for receiving a quantity of joint compound;

first and second openings adjacent said first and second end walls, respectively, and coupled with said chamber, said first and second openings being sized to receive a corner bead;

adjustment means for closing off a selected portion of said first and second openings;

a first concave, elongate channel having a first cross sectional configuration, said first channel being coupled with the interior of said chamber, said first and second openings each being aligned and in communication with said first channel in order for the corner bead to be inserted through said first opening, moved along said first channel, and withdrawn from second opening; and, an insert member having a second concave, elongate channel, the second channel having a second cross sectional configuration, said insert member being sized and configured for receipt in said first channel in order for said second channel to be positioned in said first channel so as to extend along said first channel.

6. Apparatus according to claim 5 further comprising support means coupled with said chamber for supporting said chamber in predetermined relation to a surface on which said apparatus is positioned.

* * * * *